US011412821B2

(12) United States Patent
Wang et al.

(10) Patent No.: US 11,412,821 B2
(45) Date of Patent: Aug. 16, 2022

(54) STRAIGHT-POLE SUN UMBRELLA HAND-CRANKING STRUCTURE

(71) Applicant: Linhai Guokang Leisure Products Co., Ltd., Taizhou (CN)

(72) Inventors: Ziguo Wang, Taizhou (CN); Defu Liu, Taizhou (CN)

(73) Assignee: Linhai Guokang Leisure Products Co., Ltd.

( * ) Notice: Subject to any disclaimer, the term of this patent is extended or adjusted under 35 U.S.C. 154(b) by 0 days.

(21) Appl. No.: 17/087,045

(22) Filed: Nov. 2, 2020

(65) Prior Publication Data

US 2021/0401134 A1 Dec. 30, 2021

(51) Int. Cl.
*A45B 25/14* (2006.01)
*A45B 19/04* (2006.01)

(52) U.S. Cl.
CPC ..... *A45B 25/14* (2013.01); *A45B 19/04* (2013.01)

(58) Field of Classification Search
CPC ..... A45B 19/04; A45B 25/14
See application file for complete search history.

(56) References Cited

U.S. PATENT DOCUMENTS 4,011,881 A * 3/1977 Becher ..... A45B 25/143 135/20.3
4,132,236 A * 1/1979 Petersen ..... A45B 17/00 135/16
4,674,522 A * 6/1987 Ma ..... A45B 17/00 135/20.3
4,697,606 A * 10/1987 Ma ..... A45B 17/00 135/20.3
6,722,381 B2 * 4/2004 Lai ..... A45B 25/14 135/20.3
8,365,748 B2 * 2/2013 Ma ..... A45B 25/06 135/28

* cited by examiner

*Primary Examiner* — Noah Chandler Hawk

(57) ABSTRACT

A straight-pole sun umbrella hand-cranking structure includes a standing pole and a shell fixed on the standing pole, wherein the shell comprises a first outer shell and a second outer shell. The shell is integrally fixed with one side of the standing pole, and a gear is arranged within the first and the second outer shells. A cranking shaft passes through the gear and is connected to an anti-slip mechanism, and a cranking handle is externally connected to the cranking shaft. The anti-slip mechanism includes a torsion spring, wherein the torsion spring is sleeved on the end portion of the cranking shaft. The torsion spring is arranged at the tail end of the cranking shaft such that the anti-slipping performance is improved by the elastic force of the spring. As the aforesaid structure is protected against abrasion, its functional life is significantly prolonged.

2 Claims, 2 Drawing Sheets

STRAIGHT-POLE SUN UMBRELLA HAND-CRANKING STRUCTURE

TECHNICAL FIELD

This disclosure generally relates to the technical field of sun umbrellas, and more particularly, to a straight-pole sun umbrella hand-cranking structure.

BACKGROUND

Conventional standing-pole sun umbrellas typically comprise a hand-cranking structure whose shell is arranged on the periphery of a standing pole, and a driving gear arranged within the standing pole. A hand crank sequentially passes through the front shell of the hand-cranking structure, the standing pole, and the gear until being connected to the rear shell of the hand-cranking structure. An anti-slip mechanism achieves a two-way anti-slipping through the interaction among an elastic piece, a compression spring and the gear. However, the aforesaid structure may get worn after being used for more than 50 times, and the umbrella rope may be loosened to close the umbrella. Moreover, all parts need to be assembled within the standing pole, which makes the assembly time-consuming.

SUMMARY

The purpose of the present disclosure is to provide a straight-pole sun umbrella hand-cranking structure.

To achieve the above purpose, the present disclosure adopts the following technical solution: a straight-pole sun umbrella hand-cranking structure comprising a standing pole and a shell fixed on the standing pole, wherein the shell comprises a first outer shell and a second outer shell, which is in a snap-fit with the first outer shell, wherein the shell is integrally fixed with one side of the standing pole, and a gear is arranged within the first outer shell and the second outer shell, wherein a cranking shaft passes through the gear and is connected to an anti-slip mechanism, and a cranking handle is externally connected to the cranking shaft, wherein the anti-slip mechanism is arranged in an inner cavity of the first outer shell, and the anti-slip mechanism comprises a torsion spring, wherein the torsion spring is sleeved on the end portion of the cranking shaft, and the outer surface of the torsion spring is in contact with the inner cavity of the first outer shell.

In another aspect of the present disclosure, a telescopic rod is arranged in the standing pole, an inner sliding sleeve is arranged at the bottom of the telescopic rod, and a rack is fixedly arranged between one side of the telescopic rod and the inner wall of the standing pole. An opening is formed in the standing pole for receiving the gear, and the gear is assembled into the opening such that it is meshed with the rack.

In another aspect of the present disclosure, the top portion of the standing pole is fixedly provided with a middle umbrella disc, the top portion of the telescopic rod is fixedly provided with an upper umbrella disc, and the standing pole is slidably sleeved with a lower umbrella disc.

In another aspect of the present disclosure, a fixing block is arranged at the end portion of the rack, and a gear support is arranged between the gear and the cranking shaft. A copper sleeve is arranged on the gear support, and a pressing sleeve is arranged outside the copper sleeve.

In another aspect of the present disclosure, the gear support and the torsion spring abut against and interact with each other.

Compared with the prior art, the present disclosure has the following advantages: the aforesaid structure is integrally assembled on one side surface, making the assembly of the shell convenient; the torsion spring is arranged at the tail end of the cranking shaft such that the anti-slip performance is improved by the elastic force of the spring; as the aforesaid structure is protected against abrasion, its functional life is significantly prolonged.

Figure 1:
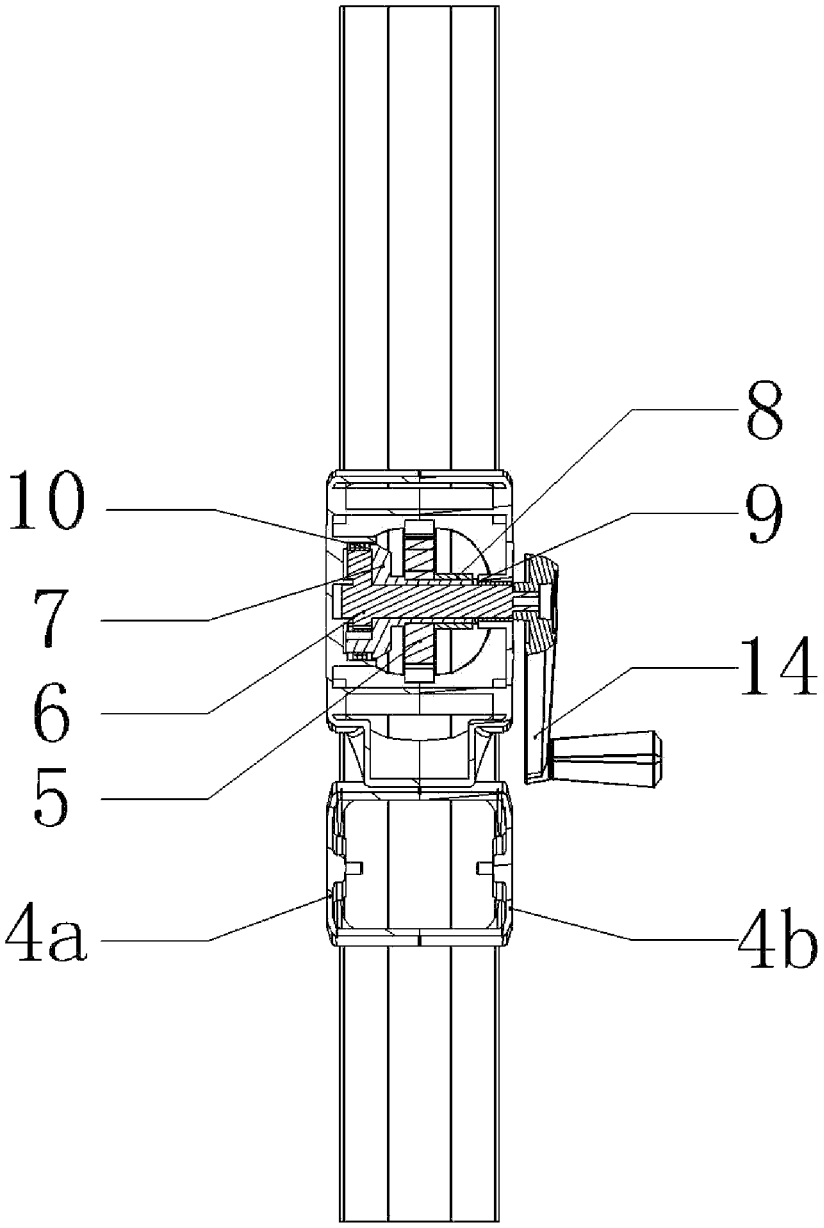
FIG. 1 is a conceptual diagram illustrating an example structure of the present disclosure.
Figure 2:
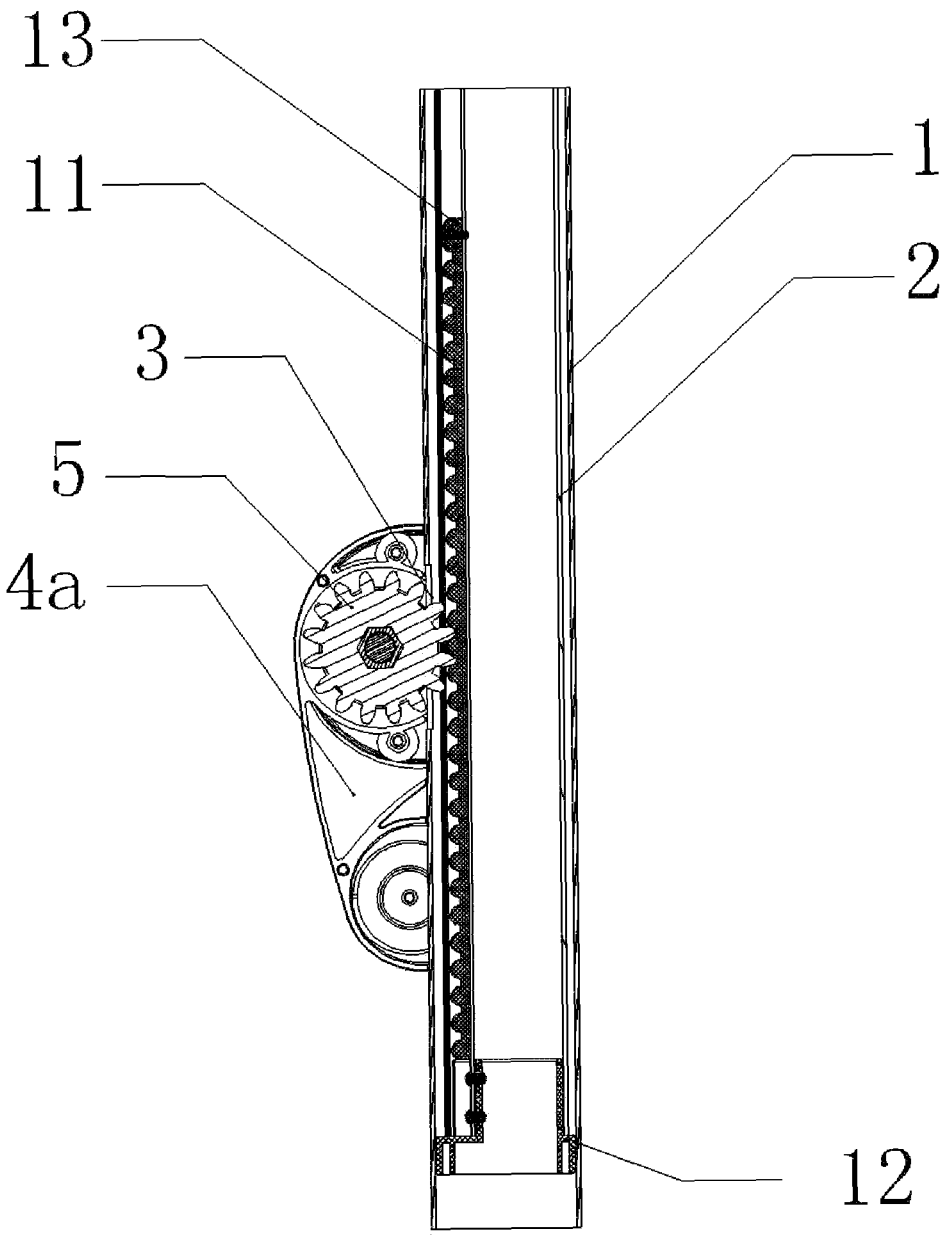
FIG. 2 is a conceptual diagram illustrating an example structure of the present disclosure during use.

In the Figures: 1—Standing Pole, 2—Telescopic Rod, 3—Opening, 4*a*—First Outer Shell, 4*b*-Second Outer Shell, 5—Gear, 6—Cranking Shaft, 7—Gear Support, 8—Pressing Sleeve, 9—Copper Sleeve, 10—Torsion Spring, 11—Rack, 12—Telescopic Rod Inner Sliding Sleeve, 13—Fixing Block, 14—Cranking Handle.

DETAILED DESCRIPTION

Figures are combined hereinafter to further elaborate the technical solution of the present disclosure.

A straight-pole sun umbrella hand-cranking structure comprises a standing pole 1 and a shell fixed on the standing pole 1, wherein the shell comprises a first outer shell 4*a* and a second outer shell 4*b*, which is in a snap-fit with the first outer shell 4*a*. The shell is integrally fixed with one side of the standing pole 1, and a gear 5 is arranged within the first outer shell 4*a* and the second outer shell 4*b*. A cranking shaft 6 passes through the gear 5 and is connected to an anti-slip mechanism. A cranking handle 14 is externally connected to the cranking shaft 6. The anti-slip mechanism is arranged in an inner cavity of the first outer shell 4*a*. The anti-slip mechanism comprises a torsion spring 10, wherein the torsion spring 10 is sleeved on the end portion of the cranking shaft 6, and the outer surface of the torsion spring 10 is in contact with the inner cavity of the first outer shell 4*a*. A telescopic rod 2 is arranged in the standing pole 1, an inner sliding sleeve is arranged at the bottom of the telescopic rod 2, and a rack 11 is fixedly arranged between one side of the telescopic rod 2 and the inner wall of the standing pole 1. An opening 3 is formed in the standing pole 1 for receiving the gear 5, and the gear 5 is assembled into the opening 3 such that it is meshed with the rack 11. To enable the gear 5 to better rotate along with the cranking shaft 6, a gear support 7 is arranged between the gear 5 and the cranking shaft 6. A copper sleeve 9 is arranged on the gear support 7, and a pressing sleeve 8 is arranged outside the copper sleeve 9. The gear support 7 and the torsion spring 10 abuts against each other, thereby preventing the torsion spring 10 from coming out such that an ideal anti-slipping performance is achieved. A fixing block 13 is arranged at the end portion of the rack 11, which ensures the telescopic rod 2 is propelled to move when the rack 11 moves. The top portion of the standing pole 1 is fixedly provided with a middle umbrella disc, the top portion of the telescopic rod 2 is fixedly provided with an upper umbrella disc, and the standing pole 1 is slidably sleeved with a lower umbrella disc. Through the movement of the telescopic rod 2, the sun umbrella may be opened and closed.

The structure of the aforesaid embodiment is only an explanation but not a limitation of the present disclosure. After reading the specification of the present disclosure, those skilled in the art may make modifications without paying creative labor. Thus, these modifications shall fall into the scope of the present disclosure.

What is claimed is:

1. A straight-pole sun umbrella hand-cranking structure, comprising:

a standing pole (1), and a shell fixed on the standing pole 1, wherein the shell comprises:

an outer shell A(4*a*), and an outer shell B(4*b*) which is in a snap-fit with the outer shell A(4*a*), wherein the shell is integrally fixed with one side of the standing pole (1), and a gear (5) is arranged within the outer shell A(4*a*) and the outer shell B(4*b*), wherein a cranking shaft (6) passes through the gear (5) and is connected to an anti-slip mechanism, and a cranking handle (14) is externally connected to the cranking shaft (6), wherein the anti-slip mechanism is arranged in an inner cavity of the outer shell A(4*a*), wherein the anti-slip mechanism comprises:

a torsion spring (10), wherein the torsion spring (10) is sleeved on the end portion of the cranking shaft (6), and the outer surface of the torsion spring (10) is in contact with the inner cavity of the outer shell A(4*a*), wherein a telescopic rod (2) is arranged in the standing pole (1), an inner sliding sleeve is arranged at the bottom of the telescopic rod (2), and a rack (11) is fixedly arranged between one side of the telescopic rod (2) and the inner wall of the standing pole (1), wherein an opening (3) is formed in the standing pole (1) for receiving the gear (5), and the gear (5) is assembled into the opening 3 such that it is meshed with the rack (11), wherein a fixing block (13) is arranged at the end portion of the rack (11), and a gear support is arranged adjacent to the cranking shaft (6), wherein a copper sleeve (9) is arranged adjacent to the cranking shaft, and a pressing sleeve (8) is arranged inwardly and adjacent to the copper sleeve (9).

2. The straight-pole sun umbrella hand-cranking structure of claim 1, wherein the gear support (7) and the torsion spring (10) abut against and interact with each other.

* * * * *